US008678132B2

(12) United States Patent
Bischel et al.

(10) Patent No.: US 8,678,132 B2
(45) Date of Patent: Mar. 25, 2014

(54) QUIET MUFFLER

(71) Applicant: Catalytic Combustion Corporation, Bloomer, WI (US)

(72) Inventors: Randall Joseph Bischel, Bloomer, WI (US); Thomas Philip King, New Auburn, WI (US)

(73) Assignee: Catalytic Combustion Corporation, Bloomer, WI (US)

( * ) Notice: Subject to any disclaimer, the term of this patent is extended or adjusted under 35 U.S.C. 154(b) by 0 days.

(21) Appl. No.: 13/721,347

(22) Filed: Dec. 20, 2012

(65) Prior Publication Data

US 2013/0153329 A1 Jun. 20, 2013

Related U.S. Application Data

(60) Provisional application No. 61/577,826, filed on Dec. 20, 2011.

(51) Int. Cl.
*F01N 13/08* (2010.01)

(52) U.S. Cl.
USPC ..... 181/228; 181/227; 181/212

(58) Field of Classification Search
USPC ..... 181/228, 227, 212
See application file for complete search history.

(56) References Cited

U.S. PATENT DOCUMENTS

| | | | | |
|---|---|---|---|---|
| 2,990,028 | A * | 6/1961 | Powers | 181/238 |
| 3,794,139 | A * | 2/1974 | Hetherington et al. | 181/238 |
| 6,457,553 | B1 * | 10/2002 | Goplen et al. | 181/272 |
| 7,878,300 | B2 * | 2/2011 | Sammut et al. | 181/249 |
| 7,895,832 | B2 * | 3/2011 | Gruber | 60/299 |
| 2002/0066619 | A1 * | 6/2002 | Collmer et al. | 181/251 |
| 2003/0098198 | A1 * | 5/2003 | Wolf et al. | 181/211 |
| 2009/0020359 | A1 * | 1/2009 | Schorn et al. | 181/228 |

* cited by examiner

*Primary Examiner* — Forrest M Phillips
(74) *Attorney, Agent, or Firm* — Renner Kenner Greive Bobak Taylor & Weber

(57) ABSTRACT

An exhaust system includes a muffler, an inlet pipe, and an exhaust pipe. The muffler includes an inlet hole adapted to receive the inlet pipe and an outlet hole to receive the exhaust pipe. The inlet pipe has a first and second linear portions extending from a radiused portion, the first and second linear portions being generally perpendicular to one another. The radiused portion and the first linear portion of the inlet pipe are positioned within the muffler. Portions of the inlet pipe and exhaust pipe located within the muffler may optionally include perforations and be closed off.

23 Claims, 4 Drawing Sheets

QUIET MUFFLER

CROSS REFERENCE TO RELATED APPLICATIONS

This application claims the benefit of U.S. provisional patent application Ser. No. 61/577,826 entitled "Quiet Muffler," filed Dec. 20, 2011, which is incorporated by reference in its entirety.

FIELD OF THE INVENTION

This disclosure relates to an improved exhaust system and muffler. More particularly, certain embodiments of this disclosure relate to an exhaust system including a muffler that is devoid of baffles, transfer tubes, and multiple expansion chambers.

BACKGROUND OF THE INVENTION

Internal combustion engines are used to power a wide array of "off-road" applications, such as lawn mowers, chainsaws and leaf blowers. Exhaust systems are provided for these engines to guide waste gases away from the engine. These systems typically direct waste gases through one or more inlet tubes to a muffler, which silences the noise of the escaping exhaust gases before they are expelled from one or more outlets. Reduction of the noise generated by the escaping exhaust gases is important in these "off-road" devices because a user of the device is often positioned in close proximity to the engine during operation of the device.

Mufflers known in the art generally comprise a number of separately manufactured components including a housing that encloses multiple internal baffles, transfer tubes, and/or expansion chambers. These known exhaust systems are expensive to manufacture due to the complexity of the systems and particularly the complexity of the muffler. This expense is further increased since exhaust systems are typically tailored for individual off-road engine designs, which vary considerably between applications and manufacturers. Consequently, for many off-road applications the exhaust system may account for a large portion of the total manufacturing expense.

Additionally, while known exhaust systems are somewhat successful in muffling the noise of the escaping exhaust gases, there is always a need and desire to improve the sound attenuation capabilities of a muffler and exhaust system.

Thus, there is a need in the art for an improved exhaust system and muffler that alleviates one or more of the deficiencies of the prior art discussed above by providing reduced assembly complexity and/or improved sound attenuation. Providing a muffler that is suitable for more than one application or engine design is also desired.

SUMMARY OF THE INVENTION

The present invention is directed to reduced noise muffler for use with an exhaust system wherein the shape and configuration of the inlet tubes and the exhaust pipe create flow patterns of the exhaust gases within a hollow shell that improve sound attenuation, thereby lowering the noise of the muffler and improving sound quality. It has also been found that by removing the baffles, transfer tubes, and multiple expansion chambers, the size of the expansion chamber can be maximized for the given muffler size. A larger expansion chamber has been found to be more effective at reducing the higher frequency noise, lowering the tone, and improving the sound quality. It has also been found that by adding perforations and closing off the ends of the inlet tubes, the exhaust pressure pulse is reduced or diffused through the perforations, further reducing the noise. The disclosed muffler also reduces back pressure and improves engine performance. Notably, the claimed reduced noise muffler does not include transfer tubes, baffles, or multiple expansion chambers as are typical in known mufflers.

In one embodiment of the claimed invention, the reduced noise muffler comprises a hollow shell member having a first end, a second end, a first inlet opening, a second inlet opening and an outlet opening, the first end spaced apart from and opposing the second end along a longitudinal axis. In at least one embodiment where the hollow shell is made from two shell members, the first inlet opening and the second inlet opening are disposed within the same shell member. The muffler further includes a first inlet tube for receiving exhaust gases. The first inlet tube passes through the first inlet opening and has a first linear portion, a second linear portion and a radiused bend located between the first and second linear portions. In one embodiment, the first linear portion of the first inlet tube is disposed or otherwise positioned or located within the first inlet opening. The muffler further includes a second inlet tube for receiving exhaust gases. The second inlet tube passes through the second inlet opening and has a first linear portion, a second linear portion and a radiused bend located between the first and second linear portions. In one embodiment, the first linear portion of the second inlet tube is disposed or otherwise positioned or located within the second inlet opening. The muffler of the present invention further includes an exhaust pipe to permit the exhaust gasses to exit the hollow shell member, the exhaust pipe extending through the outlet opening. In one embodiment, the second linear portion of the first inlet tube and the second linear portion of the second inlet tube are positioned within the muffler substantially coaxially and are generally in parallel alignment to each other and the longitudinal axis of the hollow shell member.

In one embodiment of the claimed invention, the first inlet tube and the second inlet tube each include a first open end for connecting to an engine and a second open end for bringing exhaust gases into the hollow shell member, wherein the second open end of the first inlet tube and the second open end for the second inlet tube face each other. In another embodiment of the claimed invention, the second open end of the second linear portion of the first inlet tube and the second open end of the second linear portion of the second inlet tube are blocked. In this embodiment, the second linear portion of the first inlet tube and the second linear portion of the second inlet tube are perforated to permit exhaust gasses to enter the hollow shell member. In one embodiment, the first inlet tube and the second inlet tube may also have a flange that is adapted to connect an engine.

In one embodiment of the claimed invention, the exhaust pipe further comprises a first linear portion having an end opening to permit exhaust gases to enter the exhaust pipe, a second linear portion, and a radiused bend located between the first and second linear portions. In another embodiment, the end opening of the first linear portion of the exhaust pipe may be located about 0.5 inches from one of the ends, either the first end or the second end, of the hollow shell member.

In one embodiment of the claimed invention, the end opening of the first linear portion of the exhaust pipe is blocked and the first linear portion of exhaust pipe is perforated to permit exhaust gasses to enter the exhaust pipe. In another embodiment, blocked end opening of the second linear portion of the exhaust pipe may be located about 0.5 inches from the inner surface of either the first end or the second end of the hollow shell member.

In one embodiment of the claimed invention, the muffler is devoid of baffles, transfer tubes, and multiple expansion chambers to maximize the size of a single expansion chamber within the hollow shell member. In this and other embodiments, the shape and configuration of the first and second inlet tubes and the exhaust pipe may create flow patterns for the exhaust gases within the hollow shell that improve sound attenuation, thereby lowering the noise of the muffler and improving sound quality.

In another embodiment, the reduced noise muffler of the present invention may comprise: a hollow shell member having a first end, a second end, an inlet opening, and an outlet opening. The muffler further includes an inlet tube for receiving exhaust gasses, the inlet tube passing through the inlet opening and having a first linear portion, a second linear portion and a radiused bend located between the first and second linear portions. In at least one embodiment, the first linear portion of inlet tube is positioned within the inlet opening, meaning some of the first linear portion is disposed within the shell member and some of the first linear portion is disposed outside of the shell member, while the second linear portion and the radiused bend are positioned entirely within the hollow shell member. The muffler also includes an exhaust pipe to permit the exhaust gasses to exit the hollow shell member; wherein the muffler is devoid of baffles, transfer tubes, and multiple expansion chambers to maximize the size of a single expansion chamber within the hollow shell member.

The reduced noise muffler may also include an exhaust pipe having a first end portion including a first end opening being positioned within the hollow shell member and a second end portion including a second end opening extending out of the hollow shell member through the outlet opening. The first end opening of the first end portion of the exhaust pipe may also be blocked and the second end portion of the exhaust pipe perforated to permit exhaust gasses to enter the exhaust pipe. In one embodiment, the exhaust pipe may be substantially straight.

In another embodiment, the end opening of the second linear portion of the inlet tube may be blocked and the second linear portion of the inlet tube perforated to permit exhaust gasses to enter the hollow shell member. The inlet tube may also include a flange that is adapted to connect to an engine.

BRIEF DESCRIPTION OF THE DRAWINGS

For a full understanding of the exhaust system and muffler of this disclosure reference should be made to the following detailed description and the accompanying drawings, wherein.

DETAILED DESCRIPTION OF THE ILLUSTRATIVE EMBODIMENTS

Figure 1:
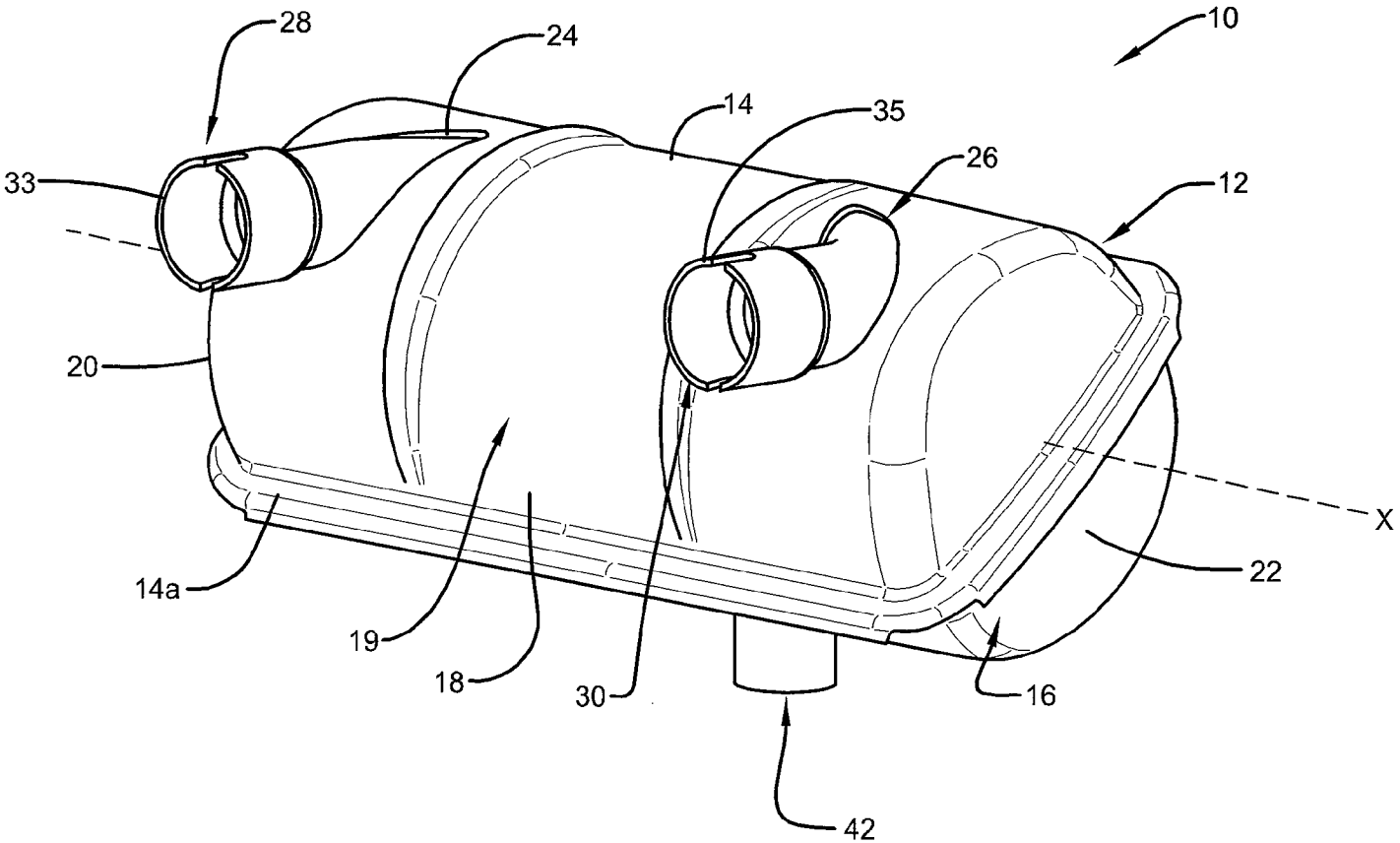
FIG. 1 is a perspective view of one embodiment of the exhaust system according to the present disclosure, the exhaust system including two inlet tubes.
Figure 2:
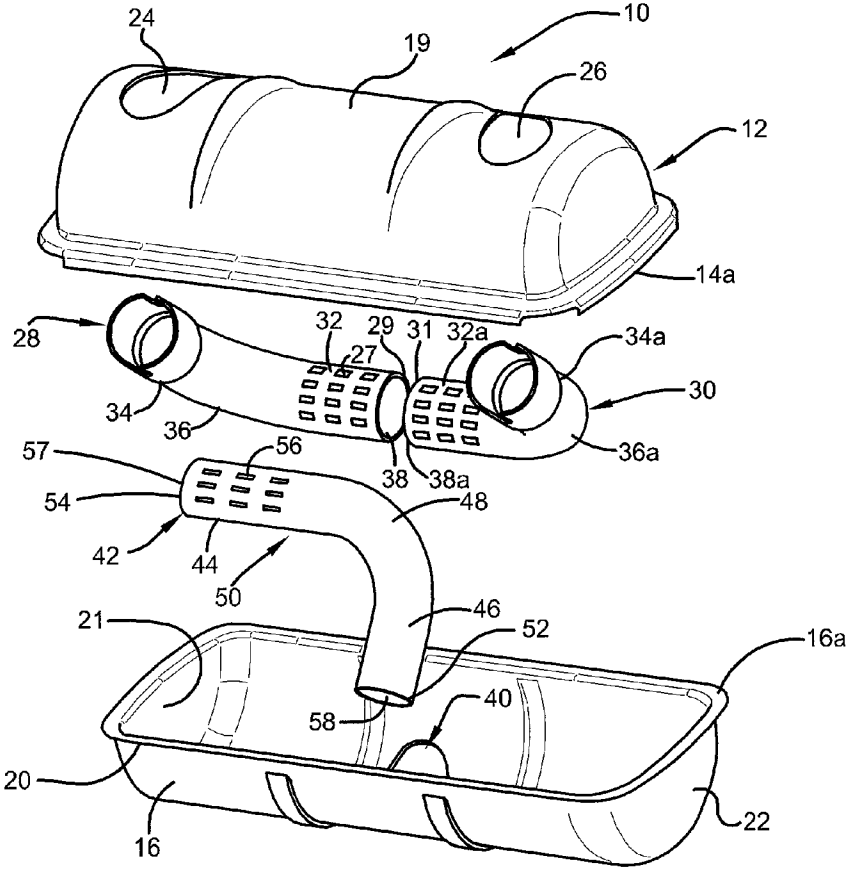
FIG. 2 is an exploded view of the exhaust system of FIG. 1.

Referring now to FIGS. 1 and 2, an exhaust system is shown, generally indicated by the numeral 10. Exhaust system 10 includes a muffler 12 formed from a first concave shell member 14 and a second concave shell member 16. In one embodiment, the first shell member 14 may be symmetrical to the second shell member 16. In other embodiments, the first shell member 14 is not symmetrical to the second shall member 16. The first and second concave shell members 14 and 16 may be stamp formed by means well known in the art. In the embodiment, where the shell members 14 and 16 are symmetrical, the shell members may be substantially the same shape and size and, in some embodiments, can be stamp formed on a single dye.

The first and second shell members 14 and 16 have opposing rims 14*a* and 16*a*, respectively, which are congruent or otherwise mate and engage to form a hollow shell 18 and defining a substantially hollow expansion 19 chamber within hollow shell 18. The hollow shell 18 has a first end 20 and a second end 22 spaced from one another. The hollow shell 18 shown in FIG. 1 and described herein is generally cylindrical. However, as will be appreciated by those skilled in the art, the hollow shell 18 may be provided in a variety of shapes or configurations as desired or necessitated by design considerations. For example, in an alternative embodiment, the shell members 14 and 16 may be relatively flat with curved edges such that the hollow shell is more "pancake-like" than cylindrical. It will be understood that there are other configurations as well and that the shapes and configurations set forth herein are not necessarily limiting to the present invention. In the embodiment shown in FIG. 1, the first and second ends 20 and 22 are generally circular and are spaced from one another in a longitudinal direction, each having a center point located on a longitudinal axis. That is, the first end 20 is spaced apart and opposes the second end 22.

The muffler 12 is formed by aligning and clamping the first and second concave shell members 14 and 16 and sealing the perimeter of the shell members at rims 14*a* and 16*a*. The sealing may be accomplished by any method or mechanism known to those skilled in the art, such as for example, crimping or seaming. This process sealably attaches or connects the first and second concave shell members 14*a* and 16*a* to one another.

The first concave shell member 14 of the muffler 12 has a first inlet hole 24 and a second inlet hole 26, each of which may be stamped out in an operation independent of the stamping of the first concave shell member 14 in one embodiment. In an alternative embodiment, the inlet holes 24 and 26 may be stamping out in the same stamping process during the manufacture of the first concave shell member 14. The location of inlet holes 24 and 26 are not limited to the locations shown in FIGS. 1 and 2, but may include other suitable locations in other embodiments. A first inlet tube 28 passes through and is positioned within the first inlet hole 24, and a second inlet tube 30 passes through and is positioned within the second inlet hole 26. A first end 29, 31 of each of the first and second inlet tubes 28 and 30, respectively, is positioned within muffler 12 to deliver exhaust gases from an engine to the muffler through the inlet holes 24 and 26. A second end 33, 35 of each of the first and second inlet tubes 28 and 30, respectively, is attached to an engine to receive exhaust gases. The inlet tubes 28 and 30 may optionally include flanges of the type shown as flange 81 in FIGS. 3 and 4 or any other type known in the art that are adapted to connect the inlet tubes to the engine at second ends 33, 35. The inlet tubes 28, 30 may also include a plurality of perforations 27 that allow for the flow of exhaust gases therethrough as the gases travel into the muffler. The inlet tubes 28, may also be closed off at end openings 38, 38*a* with a plug welded into the opening or through a crimping process.

Each of the inlet tubes 28 and 30 includes a first linear portion 32, 32*a*, a second linear portion 34, 34*a*, and a radiused bend portion 36, 36*a* (FIG. 2). The first and second linear portions 32, 32*a* and 34, 34*a* of inlet tubes 28 and 30 may be orientated generally perpendicular to one another. Both the first linear portion 32, 32*a* and the radiused bend portion 36, 36*a* of the inlet tubes 28 and 30 are positioned within the muffler 12, and the first linear portions 32 and 32*a* of the inlet tubes 28 and 30, respectively, are positioned substantially coaxially and are generally in parallel alignment to each other and the longitudinal axis x of the muffler 12. The inlet tubes 28 and 30 are sized so that the end openings 38, 38*a* of each of the first linear portions 32, 32*a* are adjacent but spaced from one another within the same longitudinal axis. In at least one embodiment, the openings 38, 38*a* of each linear portion 32 and 32*a* have essentially the same diameters. In at least one embodiment, the openings 38, 38*a* of each linear portion 32 and 32*a* face each other.

The second concave shell member 16 includes at least one outlet hole 40. In one embodiment, the second concave shell member 16 has exactly one outlet hole 40. An exhaust pipe 42 is positioned within the outlet hole 40 and includes a first linear portion 44, a second linear portion 46, and a radiused bend portion 48, similar to inlet tubes 26 and 28 discussed above. Further, exhaust pipe 42 has an inner portion 50, located within muffler 12 and an outer portion 52 that is external to muffler 12, as well as an inner opening 57 and an outer opening 58. In one embodiment, the inner portion 56 of the exhaust pipe 42 may include a plurality of perforations 56 that allow for the flow of exhaust gases therethrough as the gases travel out of the muffler. Inner opening 57 of exhaust pipe 42 may also be closed off by means of a plug (not shown) welded in the opening or through a crimping process. The first and second linear portions 44 and 46 of exhaust pipe 42 may be oriented generally perpendicular to one another. When assembled, the first linear portion 44 and radiused bend portion 48 comprise inner portion 50 and are located within the muffler 12, with the first linear portion 44 oriented generally parallel to the longitudinal axis of the muffler 12, but not within the same axis as the inlet tubes 26 and 28. In one embodiment, exhaust pipe 42 may be oriented such that inner opening 57 is spaced 0.2 to 1.5 inches, and preferably 0.5 inches from the first end of the hollow shell 18.

The exhaust pipe 42 and the first and second inlet tubes 28 and 30 are secured within the outlet hole 40 and the inlet holes 24 and 26, respectively. In certain embodiments, the inlet tubes and the exhaust pipe may be welded to the muffler at the inlet and outlet holes by any of the welding techniques discussed above with respect to sealing the hollow shell 18 of the muffler 12.

It has been discovered that the shape and configuration of the inlet tubes 28 and 30 and the exhaust pipe 42 create flow patterns of the exhaust gases within the hollow shell 18 that tends to improve sound attenuation, thereby lowering the noise of the muffler and improving sound quality. It has also been found by removing the baffles, transfer tubes, and multiple expansion chambers the size of the expansion chamber can be maximized for the given muffler size. A larger expansion chamber 19 has been found to be more effective at reducing the higher frequency noise, lowering the tone, and improving the sound quality. It has also been found that by adding perforations 27 and closing off the ends 38, 38*a* of the inlet tubes 28, 30, the exhaust pressure pulse is reduced or diffused through the perforations 27, further reducing the noise. The disclosed muffler 12 also reduces back pressure and improves engine performance. Notably, the exhaust system 10 does not include transfer tubes, baffles, or multiple expansion chambers as are typical in known mufflers.

Figure 3:
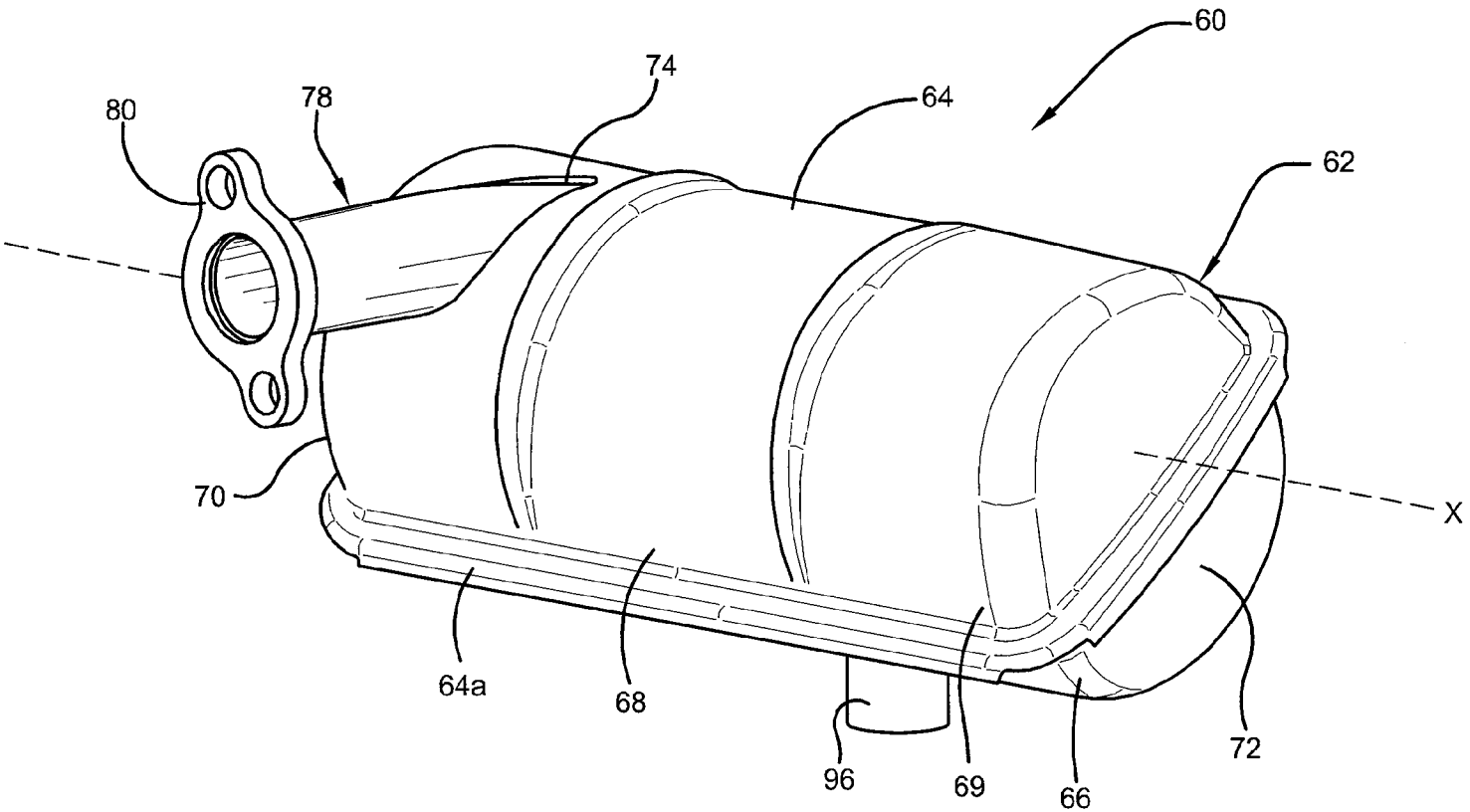
FIG. 3 is a perspective view of a second embodiment of an exhaust system according to the present disclosure, the exhaust system including a single inlet tube.
Figure 4:
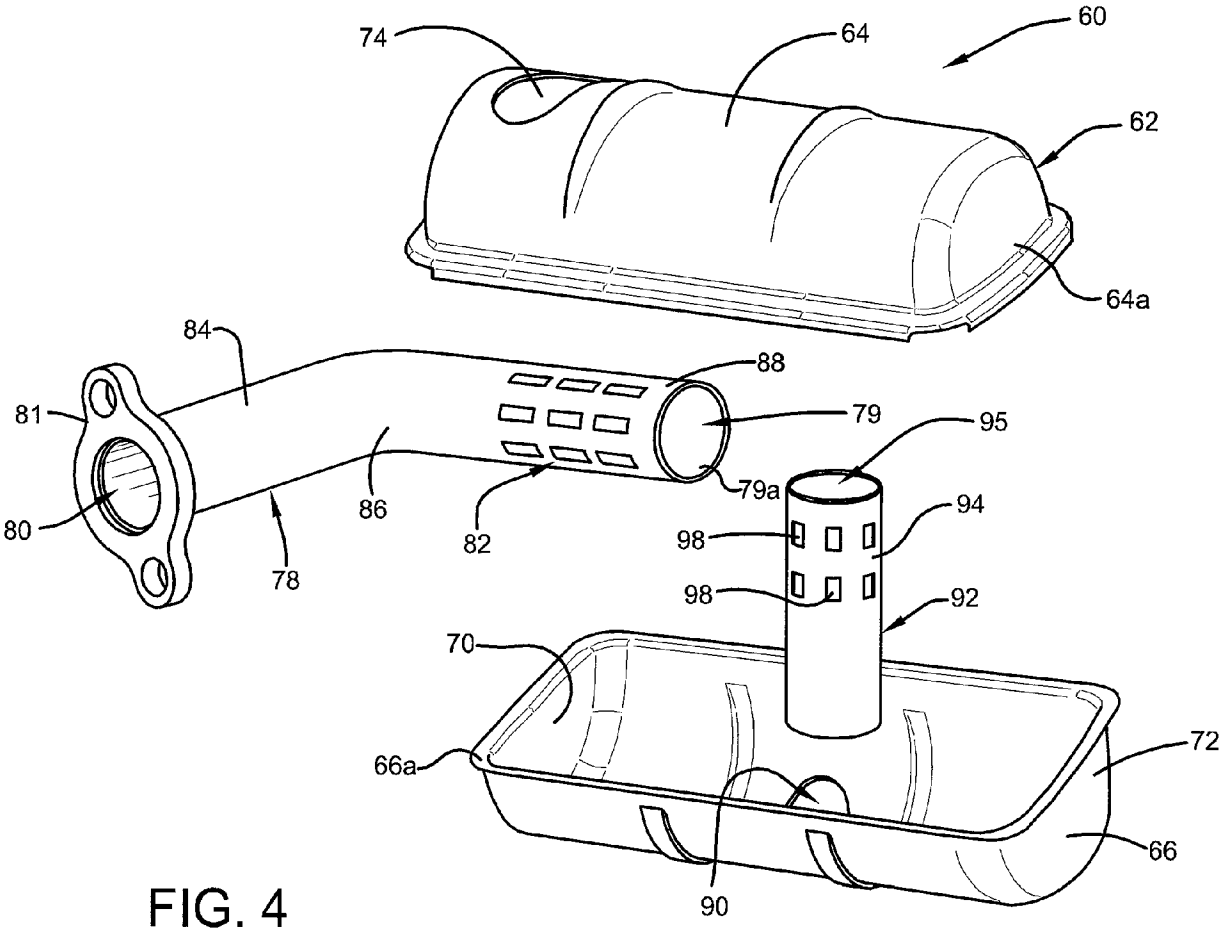
FIG. 4 is an exploded view of the exhaust system of FIG. 3.

Referring now to FIGS. 3 and 4, a second embodiment of an exhaust system according to the present disclosure is shown, and is indicated generally by the numeral 60. Exhaust system 60 includes a muffler 62 formed from a first concave shell member 64 and a second symmetrical concave shell member 66. The first and second concave shell members 64 and 66 may be stamp formed (or formed by other well known manufacturing techniques). In one embodiment, the shell members 64 and 66 may be symmetrical in that they are substantially the same shape and size and can be stamp formed on a single dye. In other embodiments, the shell members 64 and 66 are not symmetrical and the first and second shell members can be differentiated.

The first and second shell members 64 and 66 have opposing rims 64*a* and 66*a*, respectively, which mate and engage to form a hollow shell 68 and to define a substantially hollow expansion chamber 69 within hollow shell 68. The hollow shell 68 has a first end 70 and a second end 72 spaced from one another. The hollow shell 68 shown in FIG. 3 and described herein is generally cylindrical. However, as will be appreciated by those skilled in the art, the hollow shell 68 may be provided in a variety of shapes or configurations as desired or necessitated by design considerations. The first and second ends 70 and 72 are generally circular and are spaced from one another in a longitudinal direction, each having a center point located on a longitudinal axis x.

In one embodiment, the muffler 62 is formed by aligning and clamping the first and second concave shell members 64 and 66 and sealing the perimeter of the shell members at rims 64*a* and 66*a*. The sealing may be accomplished by any method or mechanism known to those skilled in the art, such as, for example, the crimping techniques discussed above with respect to muffler 12. This process sealably attaches the first and second concave shell members 64*a* and 66*a* to one another.

The first concave shell member 64 of the muffler 62 has an inlet hole 74 that may be stamped out in an operation independent of the stamping of the first concave shell member 64. The location of the inlet hole 74 is not limited to the location shown in FIGS. 3 and 4, but may include other suitable locations. An inlet tube 78 passes through and is positioned within the inlet hole 74 of muffler 62 to deliver exhaust gases from an engine into muffler 62 through the inlet hole 74. The inlet tube 78 has an inner end portion 79 and opening 79*a* within the muffler and also has an outer end portion 80, which is attached to an engine to receive exhaust gases. The outer end portion 80 of inlet tube 78 may optionally include a flange 81 that is adapted to connect the inlet tube 78 to an engine.

The inlet tube 78 further includes a first linear portion 82, a second linear portion 84, and a radiused bend portion 86 (FIG. 4). The first and second linear portions 82 and 84 of inlet tube 78 may be orientated generally perpendicular to one another. Both the first linear portion 82 and the radiused bend portion 86 of the inlet tube 78 are positioned within the muffler 62, and the first linear portion 82 of the inlet tube 78 is positioned generally parallel to and radially spaced from the longitudinal axis of the muffler 62. The first linear portion 82 also includes a plurality of perforations 88 that allow for the flow of exhaust gases therethrough as the gases travel into the muffler 62. In one embodiment, the first linear portion 82 may be closed off at opening 79*a* of inner end portion 79 by means of a plug welded into opening 79*a* or through a crimping process.

The second concave shell member 66 includes an outlet hole 90. An exhaust pipe 92 passes through and is positioned within the outlet hole 90, the exhaust pipe 92 being generally straight. The exhaust pipe is oriented generally perpendicular to the first linear portion 82 of the inlet tube 78 and the longitudinal axis of the muffler 62. The exhaust pipe 92 includes an inner portion 94 positioned having an inner opening 95 that are positioned within the muffler 62 and an outer portion 96 that extends from outlet hole 90 to the exterior of the muffler 62, protruding therefrom. The inner portion 94 of the muffler 62 may include a plurality of perforations 98 that allow for the flow of exhaust gases therethrough as the gases travel out of the muffler and, in one embodiment, may also be closed off at inner opening 95 by means of a plug welded into inner opening 95 or through a crimping process. The exhaust pipe 92, and the inlet tube 78 are secured within the outlet hole 90 and the inlet hole 74, respectively. In certain embodiments, the inlet tube and the exhaust pipe may be welded to the muffler 64 at the inlet and outlet holes 74, 90 by any of the welding techniques discussed above with respect to sealing the hollow shell 68 of the muffler 62.

It has been discovered that the shape and configuration of the inlet tube 78 and the exhaust pipe 92 create flow patterns of the exhaust gases within the hollow shell 68 that tends to improve sound attenuation, thereby lowering the noise of the muffler and improving sound quality. It has also been discovered that by adding perforations and closing off the end of the inlet tubes, the exhaust pressure pulse is reduced or diffused through the perforations, eliminating the need for additional transfer tubes, baffles, or multiple expansion chambers. By removing the said parts the size of the expansion chamber 69 can be maximized for the given muffler size. The larger expansion chamber is more effective at reducing the higher frequency noise, lowering the tone, improving the sound quality. It as further been found that by increasing the diameter of the exhaust pipe, the velocity of the exhaust gas is reduced, lowering the noise. Perforating and closing off the exhaust pipe also allows for a larger diameter outlet. The disclosed muffler also reduces back pressure and improves engine performance. Notably, the Exhaust system 60 does not include transfer tubes, baffles, or multiple expansion chambers as are typical in known mufflers.

In light of the foregoing, it should be appreciated that the present invention significantly advances the art by providing a reduced noise muffler is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A reduced noise muffler for use with an exhaust system comprising:

a hollow shell member having a first end, a second end, a first inlet opening, a second inlet opening and an outlet opening, said first end opposing said second end along a longitudinal axis;

a first inlet tube for receiving exhaust gases, said first inlet tube passing through said first inlet opening and having a first linear portion, a second linear portion and a radiused bend located between said first and second linear portions, wherein at least one of said first linear portion and said radiused bend of said first inlet tube is positioned within said first inlet opening;

a second inlet tube for receiving exhaust gases, said second inlet tube passing through said second inlet opening and having a first linear portion, a second linear portion and a radiused bend located between said first and second linear portions, wherein at least one of said first linear portion and said radiused bend of said second inlet tube is positioned within said second inlet opening; and an exhaust pipe to permit the exhaust gases to exit said hollow shell member, said exhaust pipe extending through said outlet opening;

wherein the second linear portion of said first inlet tube and the second linear portion of said second inlet tube are positioned essentially fully within said hollow shell member and are substantially coaxial and are generally in parallel alignment to each other and the longitudinal axis of said hollow shell member.

2. The reduced noise muffler of claim 1, wherein each of said first inlet tube and said second inlet tube further comprise a first open end, for connecting to an engine, and a second open end, for bringing exhaust gases into said hollow shell member, wherein said first inlet tube and said second inlet tube are oriented so that the second open end of said first inlet tube and the second open end for said second inlet tube face each other.

3. The reduced noise muffler of claim 2, wherein the second open ends of the second linear portion of said first inlet tube and the second linear portion of said second inlet tube are blocked and the second linear portion of said first inlet tube and the second linear portion of said second inlet tube are perforated to permit exhaust gases to enter said hollow shell member.

4. The reduced noise muffler of claim 1, wherein said exhaust pipe further comprises a first linear portion having an end opening to permit exhaust gases to enter said exhaust pipe, a second linear portion and a radiused bend located between said first and second linear portions.

5. The reduced noise muffler of claim 4, wherein said end opening of said first linear portion of said exhaust pipe is located about 0.5 inches from said first end of said hollow shell member.

6. The reduced noise muffler of claim 4, wherein:

said end opening of said first linear portion of said exhaust pipe is blocked; and said first linear portion of said exhaust pipe is perforated to permit exhaust gasses to enter said exhaust pipe.

7. The reduced noise muffler of claim 6, wherein said blocked end opening of said first linear portion of said exhaust pipe is located about 0.5 inches from the inner surface of said first end of said hollow shell member.

8. The reduced noise muffler of claim 1, wherein said first inlet tube and said second inlet tube each further comprise a flange that is adapted to connect an engine.

9. The reduced noise muffler of claim 1, wherein said muffler is devoid of baffles, transfer tubes, and multiple expansion chambers to maximize the size of a single expansion chamber within said hollow shell member.

10. The reduced noise muffler of claim 1, wherein the shape and configuration of the first and second inlet tubes and the exhaust pipe create flow patterns of the exhaust gases within said hollow shell that improve sound attenuation, thereby lowering the noise of the muffler and improving sound quality.

11. The reduced noise muffler of claim 1 wherein at least one of said first inlet opening and said second inlet opening are generally teardrop shaped.

12. The reduced noise muffler of claim 1 wherein at least one of said first inlet opening and said second inlet opening have a curved teardrop shape to accommodate at least a portion of the radiused bend in at least one of said first inlet tube and said second inlet tube therein.

13. A reduced noise muffler for use with an exhaust system comprising:

a hollow shell member having a first end, a second end, an inlet opening, and an outlet opening;

an inlet tube for receiving exhaust gasses, said inlet tube passing through said inlet opening and having a first linear portion, a second linear portion and a radiused bend located between said first and second linear portions, wherein said first linear portion is positioned within said inlet opening and said second linear portion and said radiused bend are positioned within said hollow shell member; and an exhaust pipe to permit the exhaust gasses to exit said hollow shell member;

wherein said muffler is devoid of baffles, transfer tubes, and multiple expansion chambers to maximize the size of a single expansion chamber within said hollow shell member.

14. The reduced noise muffler of claim 13, wherein said exhaust pipe further comprises a first end portion including a first end opening positioned within said hollow shell member and a second end portion including a second end opening, said second end portion extending out of said hollow shell member through said outlet opening.

15. The reduced noise muffler of claim 13, wherein said exhaust pipe is substantially straight.

16. The reduced noise muffler of claim 13, wherein said end opening of said second linear portion of said inlet tube is blocked and said second linear portion of said inlet tube is perforated to permit exhaust gasses to enter said hollow shell member.

17. The reduced noise muffler of claim 13, wherein said inlet tube further comprises a flange that is adapted to connect to an engine.

18. The reduced noise muffler of claim 14, wherein:

said first end opening of said first end portion of the exhaust pipe is blocked; and said second end portion of said exhaust pipe is perforated to permit exhaust gasses to enter said exhaust pipe.

19. The reduced noise muffler of claim 13, wherein the shape and configuration of the inlet tube and the exhaust pipe create flow patterns of the exhaust gases within said hollow shell that improve sound attenuation, thereby lowering the noise of the muffler and improving sound quality.

20. The reduced noise muffler of claim 13 wherein said inlet opening is generally teardrop shaped.

21. The reduced noise muffler of claim 13 wherein at least a portion of the radiused bend is positioned within said inlet opening and said inlet opening has a curved teardrop shape shape to accommodate said at least a portion of the radiused bend therein.

22. A reduced noise muffler for use with an exhaust system comprising:

a generally cylindrical shell defining a substantially hollow expansion chamber, the shell having a first end, a second end, and at least one inlet opening, wherein said first end opposes said second end to define a longitudinal axis therebetween at the radical center of the shell;

at least one inlet tube for receiving exhaust gases, the at least one inlet tube having at least a portion passing through the at least one inlet opening, the at least one inlet opening having a shape selected from the group consisting of a generally teardrop shape and a curved teardrop shape, wherein the at least one inlet tube is offset from and does not substantially pass through the longitudinal axis.

23. The reduced noise muffler of claim 22, wherein the at least one inlet tube includes a first linear portion, a second linear portion and a radiused bend located between the first linear portion and the second linear portion, wherein if the at least one inlet opening is generally teardrop shape, then the first linear portion of the at least one first inlet tube is positioned within the at least one inlet opening, and if the at least one inlet opening is curved teardrop shape, then the radiused bend of the at least one first inlet tube is positioned within the at least one inlet opening.

* * * * *